US009015982B1

(12) United States Patent
Powers

(10) Patent No.: US 9,015,982 B1
(45) Date of Patent: Apr. 28, 2015

(54) LEVEL-INDICATING SCOPE MOUNT

(71) Applicant: John D. Powers, Orofino, ID (US)

(72) Inventor: John D. Powers, Orofino, ID (US)

(73) Assignee: Michael I. Powers, Orofino, ID (US)

( * ) Notice: Subject to any disclaimer, the term of this patent is extended or adjusted under 35 U.S.C. 154(b) by 114 days.

(21) Appl. No.: 13/658,722

(22) Filed: Oct. 23, 2012

(51) Int. Cl.
*F41G 1/38* (2006.01)
*F41G 11/00* (2006.01)
*F41G 1/467* (2006.01)

(52) U.S. Cl.
CPC ..... *F41G 11/003* (2013.01); *F41G 1/467* (2013.01)

(58) Field of Classification Search
CPC ..... F41G 1/467; F41G 1/38; F41G 1/545; F41G 1/10; F41G 11/003
USPC ..... 42/124–128
See application file for complete search history.

(56) References Cited

U.S. PATENT DOCUMENTS

| | | | | |
|---|---|---|---|---|
| 168,941 | A | 10/1875 | Treadway | |
| 5,406,733 | A * | 4/1995 | Tarlton et al. | 42/119 |
| 5,878,504 | A | 3/1999 | Harms | |
| 6,813,855 | B2 | 11/2004 | Pinkley | |
| 2007/0113460 | A1 | 5/2007 | Potterfield et al. | |
| 2007/0144051 | A1 | 6/2007 | Moore et al. | |
| 2008/0134561 | A1* | 6/2008 | Clouser | 42/113 |
| 2011/0271535 | A1* | 11/2011 | Varner et al. | 33/265 |

FOREIGN PATENT DOCUMENTS

| | | | |
|---|---|---|---|
| DE | 20 2007 003 541 | U1 | 8/2007 |
| GB | 2332039 | A | 9/1999 |
| WO | WO 2011/031204 | A1 | 3/2011 |

* cited by examiner

*Primary Examiner* — Samir Abdosh
(74) *Attorney, Agent, or Firm* — Brian C. Trask

(57) ABSTRACT

A fixture structured to attach a scope to a rifle. The fixture includes a level-vial that is visible by a shooter who is substantially at a conventional horizontal shooting position. In such position, the bubble element of the level-vial is disposed below the scope, and at a location that is intersected by a vertical plane containing the centerline of the rifle barrel.

20 Claims, 10 Drawing Sheets

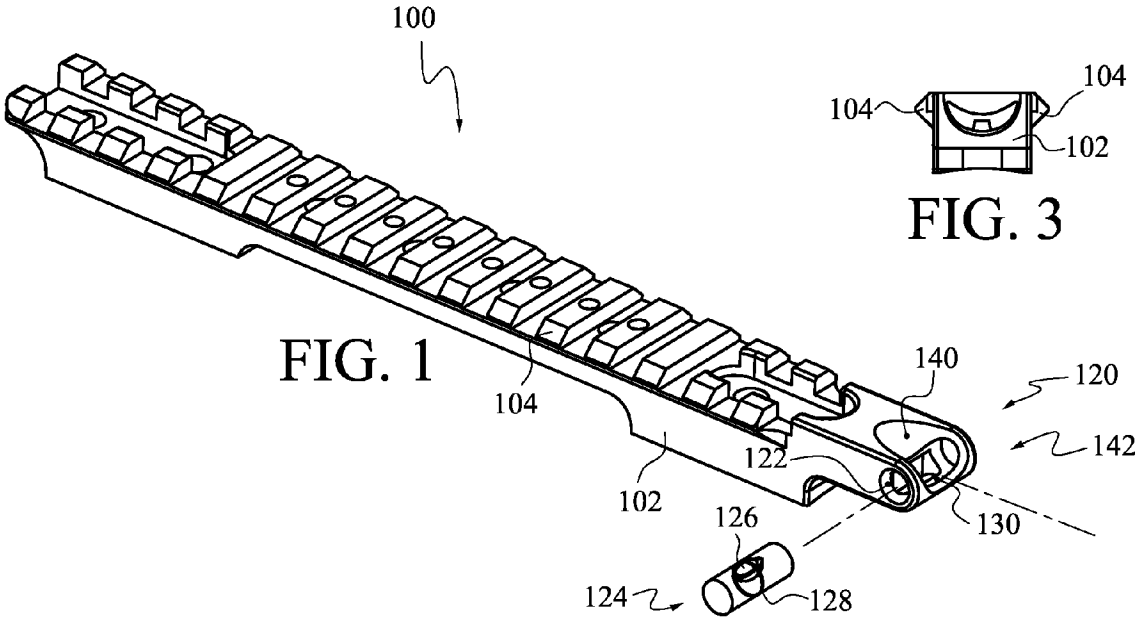
FIG. 1
FIG. 3
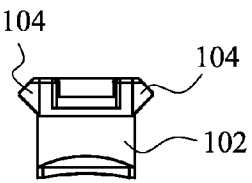
FIG. 2
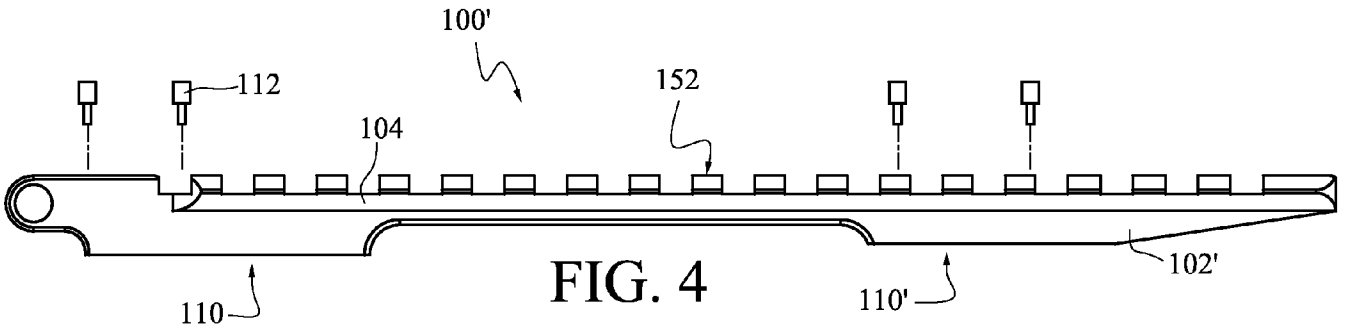
FIG. 4

FIG. 13
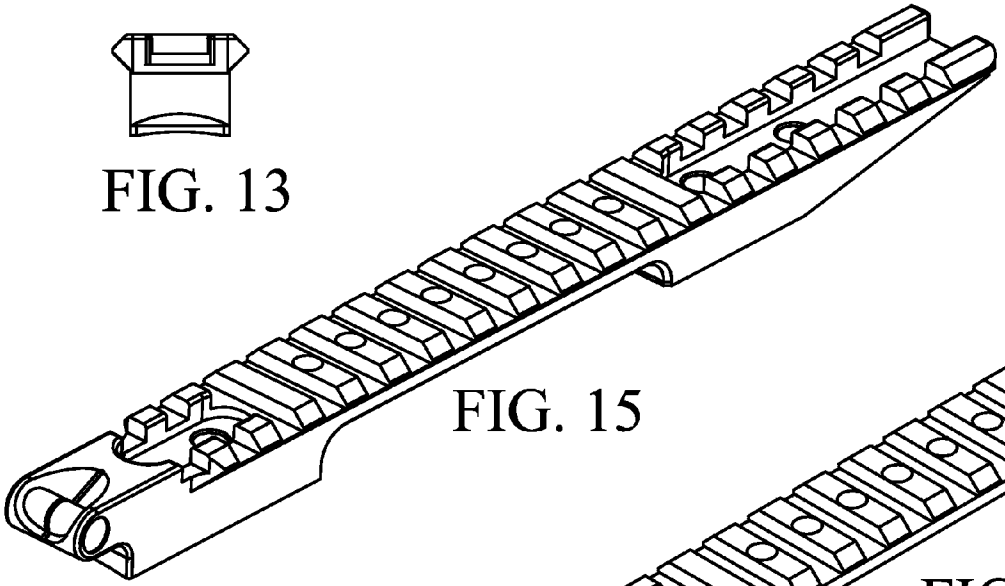
FIG. 15
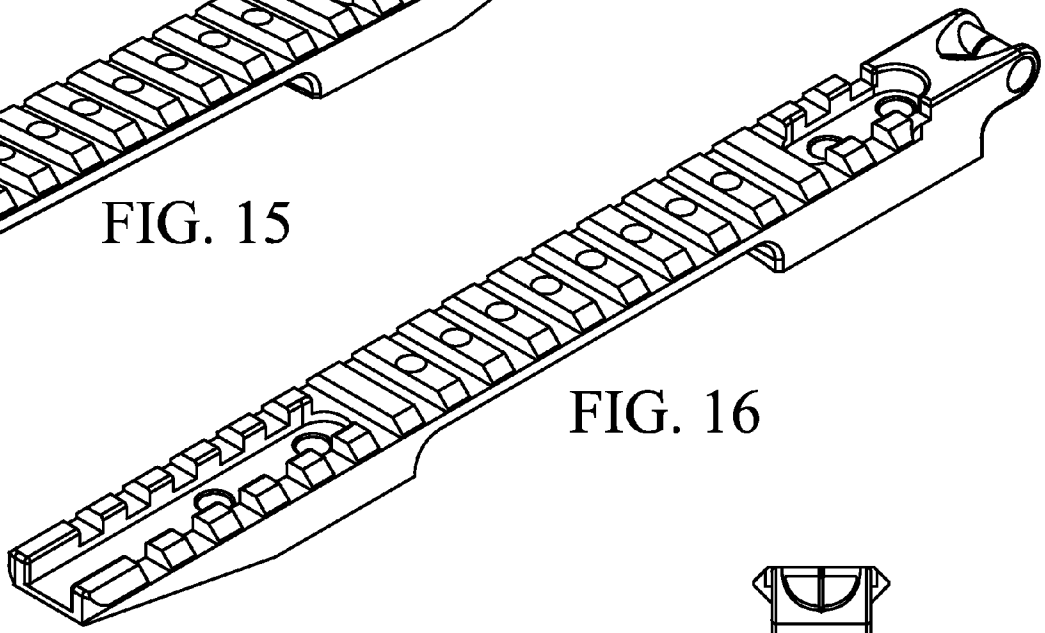
FIG. 16
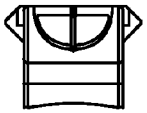
FIG. 14

FIG. 22
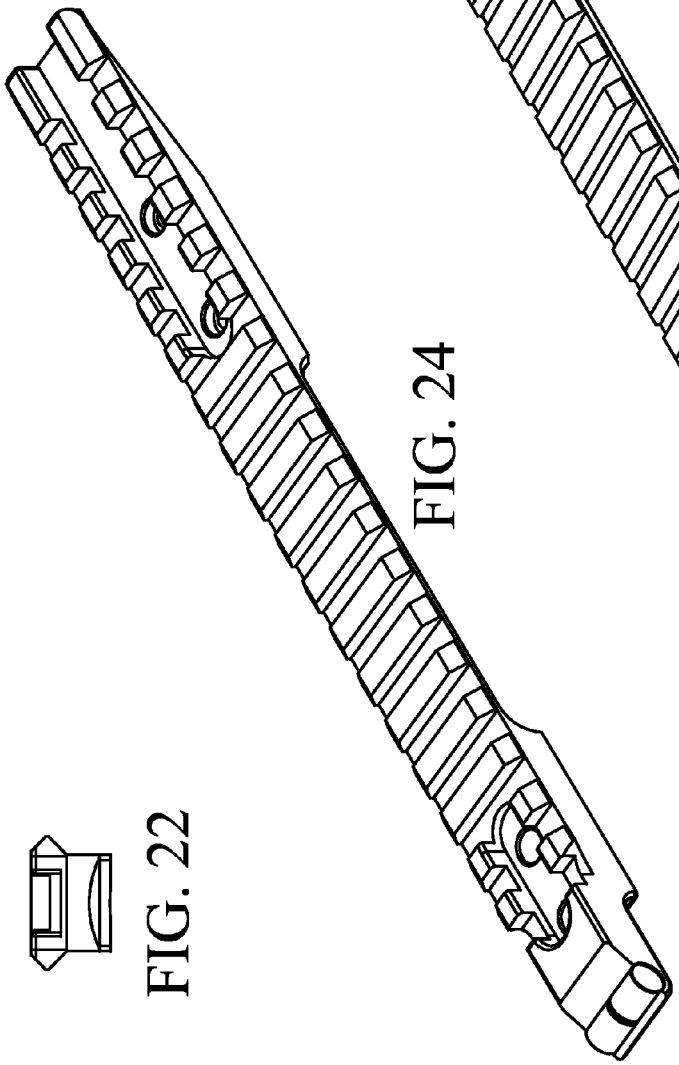
FIG. 24
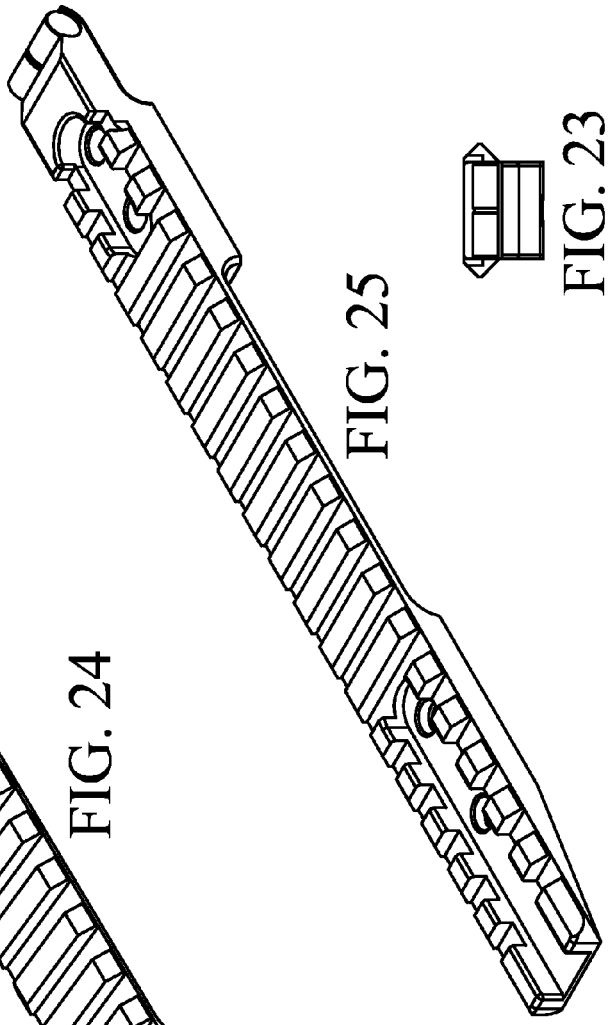
FIG. 25
FIG. 23

LEVEL-INDICATING SCOPE MOUNT

BACKGROUND

1. Field of the Invention

This invention relates to devices to indicate ballistic trajectories. Certain embodiments are particularly adapted for use to improve accuracy of bullet placement in long-range rifle shooting.

2. State of the Art

Accurate long-range shooting generally requires careful vertical alignment of a rifle barrel and sight system. A baseline trajectory typically assumes a projectile path is contained in a vertical plane. Conventionally, a sight element, such as a scope reticle, is placed into agreement with a vertical plumb line, and it remains up to the shooter to maintain that orientation when making a shot. Departure of the rifle and sight element from vertical agreement with the plumb line may be characterized as cant, which throws a projectile to either one side, or the other, as target range changes. The amount of undesired side travel of a projectile increases directly with increase in both range distance and cant angle.

Various arrangements have been developed to provide a shooter feedback that the rifle sight system is in a proper plumb orientation. It is known to provide a level-indicating element on a transversely-protruding lever element that can be removably anchored to a scope-mounting base. Such an arrangement undesirably positions the level-indicator in free space where the lever element is subject to damage from bumping into foreign objects. Bumping the protruding lever can knock the level-indicator out of its desired plumb orientation.

It is also known to include a level-indicator on a scope ring cap. However, great care must be taken when installing such a device, because the cap can be tightened down in an un-even fashion, and the gap between the top and bottom scope ring will allow the cap to be pulled out of plumb when tightening the cap-mounting screws.

It is also known to mount a level-indicator directly to a rifle scope. Unfortunately, this requires another level placed on the bolt rails of the rifle to get the gun level, then plumbing the cross hair in the scope to a vertical plumb line to get the whole setup plumb and level. The known prior art suffers by requiring a shooter to lift his/her head up from a conventional horizontal shooting position (raise his/her cheek from the rifle stock) to check the level to verify a proper shooting orientation of the system, just before pulling the trigger.

It would be an advance to provide a feedback system for proper rifle orientation that is simple to set up, robust to avoid accidental departure from a desired plumb orientation, and visible by a shooter from a cheek-down shooting position.

BRIEF SUMMARY OF THE INVENTION

This invention provides a mounting fixture of the type capable of joining a scope to a rifle. One such fixture includes a level-indicating element incorporated as a non-removable element. Desirably the level-indicating element is disposed at an information-broadcast location at which a shooter of the rifle may visually obtain feedback regarding cant of the rifle on which that fixture is mounted while the shooter remains substantially in a conventional cheek-down shooting position.

Typically, the information-broadcast location is intersected by a vertical plane passing through a bore centerline of a barrel of the rifle when the rifle is disposed in the horizontal shooting orientation. The information-broadcast location can be vertically disposed between the scope and rifle. The information-broadcast location of preferred scope mounting fixtures structured according to certain principles of the invention is vertically disposable between an optical axis of the scope and the barrel centerline of the rifle on which the fixture may be installed. Most desirably, the information-broadcast location provided by a scope-mounting fixture is vertically disposable below an optical axis of a scope mounted there-on.

A level-indicating element may be disposed inside a socket carried by a scope-mounting fixture structured according to certain principles of the invention. By the term "socket" it is intended to broadly encompass structure operable to hold a cylinder at a desired orientation in space. A skeletal fragment of a cylindrical hole may be sufficient, for example. In any case, the socket typically has a length axis disposed transverse to a length axis of the fixture. A wall portion of such socket may include a first opening through which an adhesive may be applied to maintain the level-indicating element in installed registration inside the socket. A wall portion of the socket may include a first opening through which an element may be inserted to maintain the level-indicating element in installed registration inside the socket.

A wall portion of the socket may also include a second opening through which a shooter may observe a bubble. In a preferred embodiment, a boundary of the second opening includes a proximally-sloping arcuate surface configured to direct ambient light through the bubble and toward an eye of said shooter. In general, it is desirable for a boundary of the second opening to includes an arcuate surface configured to additionally illuminate the bubble with ambient light.

Preferred embodiments of a scope-mounting fixture include a rifle-contact interface structured for bolt-on coupling of the fixture to a rifle effective to position a level-indicating element in operable association with the rifle simply by way of coupling the fixture to the rifle. A workable rifle interface includes a plurality of axially spaced-apart contact surface areas, each such contact surface being configured in agreement with a cooperating mounting surface of a rifle. An operable fixture also includes a scope interface configured to couple with intermediary scope ring structure effective to hold a scope in registered assembly to the fixture. Sometimes, plurality of sockets may be disposed perpendicular to, and opening to, a top surface of the fixture, the length axes of the sockets being spaced apart along a length axis of the fixture and disposed transverse to a length axis of the level-indicating element.

The invention may be embodied as an improved picatinny rail structured in substantial accordance with MIL-STD-1913 (AR) 3 Feb., 1995. Such an improved device includes a level-indicating element incorporated as a non-removable element of the rail, the level-indicating element being disposed at an information-broadcast location at which a shooter of the rifle may visually obtain feedback regarding cant of the rifle on which the rail is mounted while the shooter remains substantially in a conventional horizontal shooting position. A plurality of sockets may sometimes be disposed perpendicular to, and opening to, a top surface of the rail, the length axes of the sockets being spaced apart along a length axis of the rail and disposed transverse to a length axis of the level-indicating element. Typically, the level-indicating element is disposed in a socket having a length axis transverse to a length axis of the rail, the level-indicating element comprising a bubble intersected by a vertical plane passing through a length axis of the rail when installed on a rifle and disposed in a conventional horizontal shooting orientation, the bubble then being disposed at a position to permit observation by a shooter at an elevation between a scope mounted to the rail and a rifle on which the rail is mounted. Typically, a wall portion of the socket includes a first opening through which an element may be inserted to maintain the level-indicating element in installed registration inside the socket. Also, a wall portion of the socket includes a second opening through which a shooter may observe the bubble.

The invention may be embodied as a scope mount for a rifle. Such a scope mount includes a level-vial incorporated as a conventionally non-removable element of the mount. A level-vial may conveniently be disposed in a socket formed in the proximal end of the mount and having a center-axis transverse to a length axis of the mount. Desirably, the socket is oriented to be horizontal when installed on a cooperating rifle, and the rifle is placed in a conventional horizontal shooting position. Such orientation inherently places the level-vial in a plumb condition to indicate any cant that might be present when the rife is ready to shoot. A rifle-contact interface of the mount is configured to automatically orient the level-vial with respect to a cooperatingly-structured rifle, simply by bolt-on attachment of the scope mount to the rifle. Desirably, a bubble element of the level-vial may be disposed for intersection by a vertical plane passing through the length axis when the rifle, on which the scope mount is installed, is disposed in a conventional horizontal shooting orientation, the bubble element then being disposed at a position to permit cheek-down observation by a shooter at an elevation between a scope affixed to the mount and the rifle. That is, the shooter is not required to raise his/her cheek from the rifle stock to observe the bubble. A wall portion of a workable socket includes a first opening through which a shooter may observe the bubble in the level-vial to visually obtain feedback regarding cant of the rifle.

BRIEF DESCRIPTION OF THE DRAWINGS

In the drawings, which illustrate what are currently considered to be the best modes for carrying out the invention:

FIG. 1 is a view in perspective from above, partially exploded, of an embodiment structured according to certain principles of the invention;

FIG. 2 is a distal end view of the embodiment in FIG. 1;

FIG. 3 is a proximal end view of the embodiment in FIG. 1;

FIG. 4 is a side view in elevation of an embodiment similar to the embodiment in FIG. 1;

FIGS. 10-27 illustrate a pair of scope mounts structured according to certain ornamental aspects of the invention.

DETAILED DESCRIPTION OF THE ILLUSTRATED EMBODIMENTS

Figure 5:
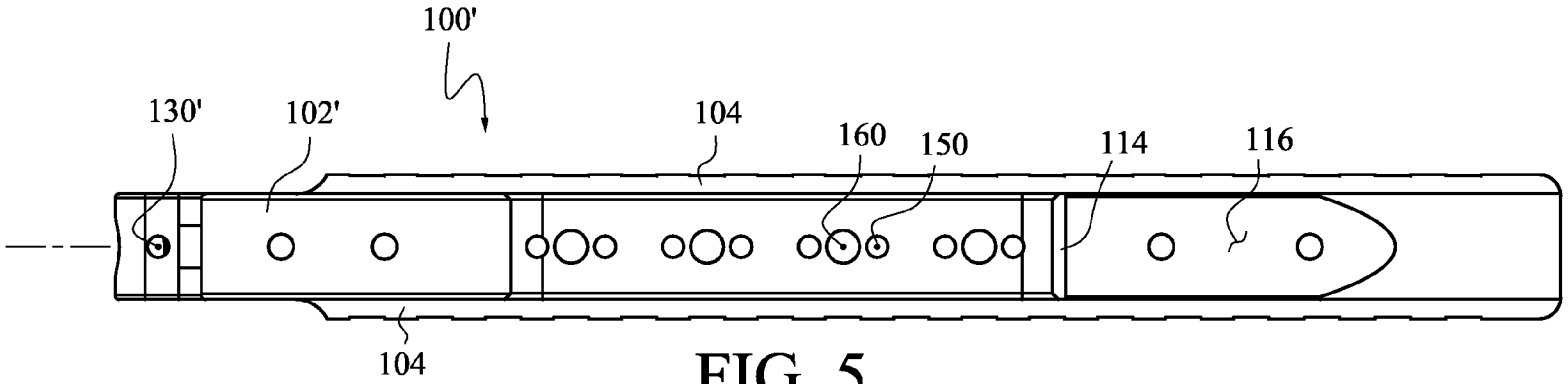
FIG. 5 is a bottom view of the embodiment in FIG. 4.

Reference will now be made to the drawings in which the various elements of the illustrated embodiments will be given numerical designations and in which the invention will be discussed so as to enable one skilled in the art to make and use the invention. Similar elements having different shapes may sometimes be indicated by the same numeral followed by a prime. It is to be understood that the following description is only exemplary of the principles of the present invention, and should not be viewed as narrowing the claims which follow.

An exemplary embodiment of a scope mount structured according to certain principles of the invention is illustrated generally at 100 in FIG. 1. Scope mount 100 is representative of a scope mount that may be characterized as a picatinny rail, certain characteristics of which are set forth in MIL-STD-1913 (AR) 3 Feb., 1995, which is hereby incorporated in its entirety as a portion of this disclosure by this reference. At the time of this writing, a copy of MIL-STD-1913 (AR) 3 Feb., 1995 is available on the world wide web at the web site address biggerhammer.net/picatinny/1913_specs.pdf.

Scope mount 100 includes an elongate rail element, or body, 102. As best illustrated in FIGS. 3 and 4, body 102 includes oppositely-protruding triangular structure 104 forming an elongate male dovetail rail configured to receive corresponding female structure of commercially available scope ring bases at two or more axially spaced-apart locations. Further, body 102 typically includes one or more rifle-interface surface, generally indicated at 110 and 110' in FIG. 4, that is/are machined to fit precisely in mating compression contact with cooperating surface structure of a rifle, or group of rifles (not illustrated). It should be noted that areas 110 and 110' are not necessarily identical in size or shape, or even disposed at the same elevation, depending on the rifle model for which the scope mount 100 (or 100', etc.) is intended to properly interface. A plurality of fasteners, such as socket head cap screw 112, are generally used to secure the body 102 to the cooperatingly structured rifle.

Figure 7:
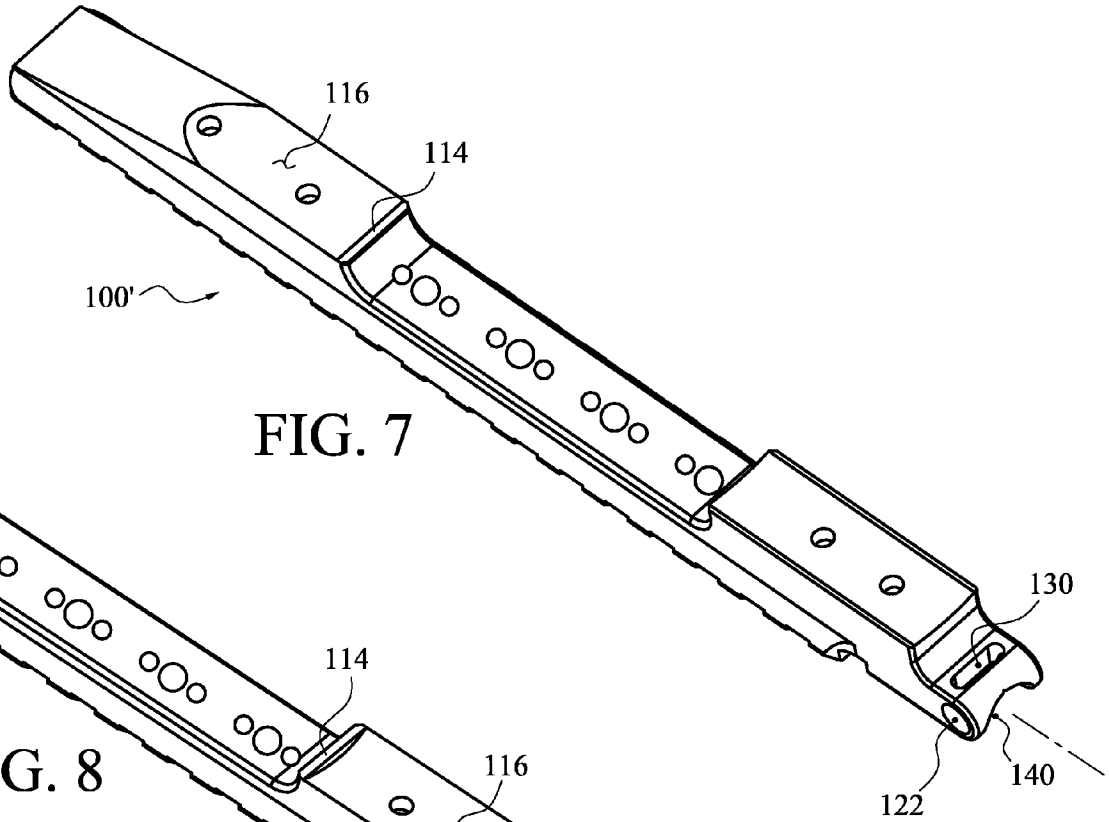
FIG. 7 is a bottom view of the embodiment in FIG. 4 in perspective from the proximal end.
Figure 8:
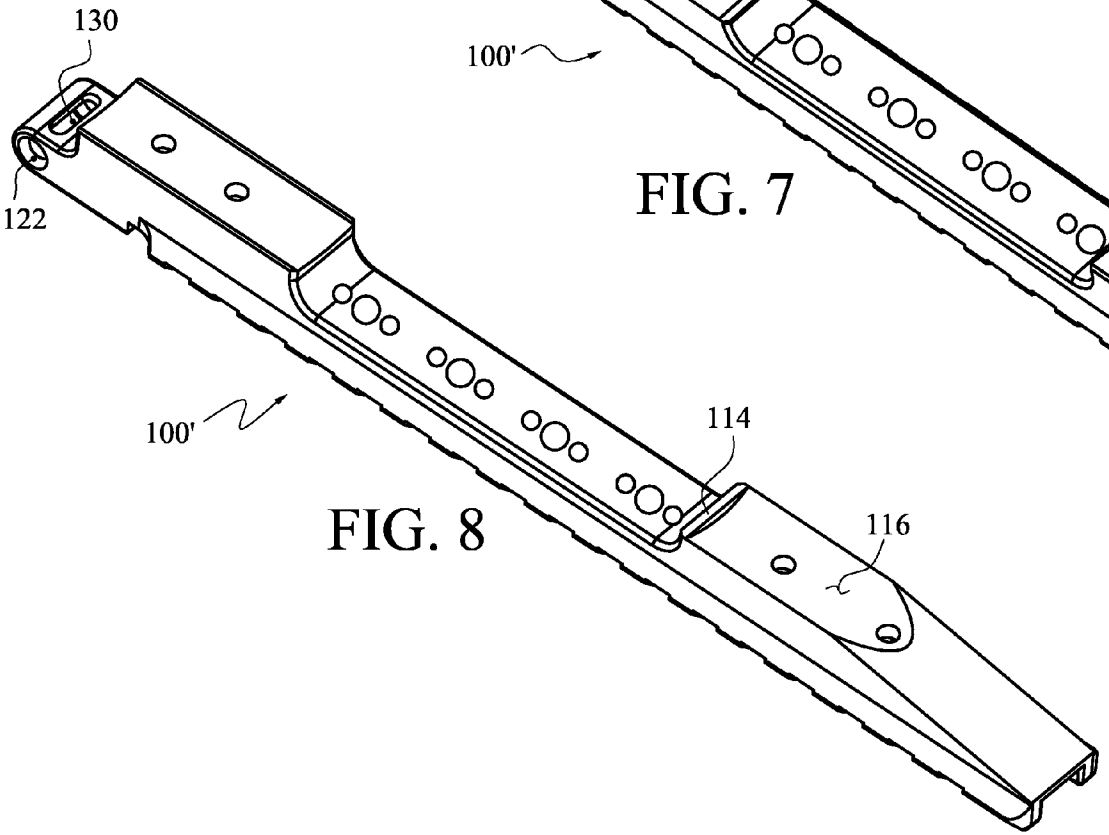
FIG. 8 is a bottom view of the embodiment in FIG. 4 in perspective from the distal end.

With reference to FIGS. 7 and 8, sometimes a recoil lug, such as lug 114, may be formed on the bottom surface of body 102 to cause a structural interference with cooperating structure of a rifle effective to resist axial displacement of the body 102 with respect to the rifle under a severe bump-load or recoil event. As illustrated, surface 116 may be partially machined away to leave behind recoil lug 114. It will be appreciated that alternatively structured elements may be provided to cause a structural interference effective to resist relative motion between a scope mount and a rifle on which it is installed.

Desirably the body 102 is sufficiently stiff as to avoid bending under accidental bump-loading. It is currently preferred for body 102 to be machined from a solid block of metal, such as Aluminum, and subsequently hard-anodized. Alternative forming processes, such as forging, casting, molding, and the like, as well as alternative materials including stiff plastics, ceramics, and composite materials such as carbon/epoxy, fiber-reinforced plastics (FRP), and the like, may be operable in certain circumstances.

With reference again to FIG. 1, the proximal end, generally 120, of body 102 carries a socket 122 in which is received a level-indicating element, generally 124. A workable level-indicating element 124 includes level-vial #0150 with a level sensitivity of 46 arc minutes that is commercially available from Empire Level at a world wide web address of empire-level.com/level-vials/acrylic-level-vials/index.php. Such level-vial includes an internal bubble 126 and a single indicator reference line 128. A level-vial has the advantages of low cost and simplicity. However, alternative level-indicating elements are within contemplation, including electronic elements and circuits configured to emit a visible signal when the associated rifle is in a desired cant-free orientation.

Illustrated socket 122 passes completely through body 102 in a direction transverse to the length axis extending between proximal and distal ends of body 102. However, a partial-depth socket 122 is also workable, if desired. It is currently preferred to provide a slip fit between the level-vial 124 and the circumscribing wall of the socket 122. It is also currently preferred for level-indicating element 124 to be a conventionally non-removable element. That means, something must first be destroyed in order to remove a level-vial 124 from seated engagement inside socket 122 of a fully-assembled embodiment 100, 100'. However, it is also within contemplation that a level-vial 124 may be removed from certain embodiments, e.g for replacement of a damaged vial, or to change to a different level-vial having a different sensitivity.

Of note, a wall portion of socket 122 includes an opening 130 through which an adhesive may be applied to maintain level-indicating element 124 in installed registration inside socket 122. With reference to FIG. 5, an operable opening 130' permits application of a suitable adhesive from the bottom of the body 102. It has been discovered that a workable adhesive includes Permabond 910™ super glue. Such glue is currently commercially available on the world wide web at permabondllc.com/TDS/910_TDS.pdf. A workable adhesive does not damage the acrylic level-vial material, but does at least adhere to the vial and cause a structural interference with the edge of opening 130. The currently preferred adhesive also forms a bond with the currently preferred hard anodized Aluminum body 102. Of course, alternative ways to hold a level vial in installed position are operable, including simple threaded fasteners, pins, O-rings, or other structurally interfering and/or high-friction elements configured to resist withdrawal of a seated level-vial 124, and the like.

Of further note, a wall portion of socket 122 includes an opening 140 through which a shooter may visually obtain feedback regarding cant of the rifle on which a fixture 100 is mounted while that shooter remains substantially in a conventional horizontal shooting position. Desirably, the level-indicating element (e.g. bubble 126) is disposed at an information-broadcast location, generally 142, that merely requires the shooter to move his/her eye focus from through-scope to the level-indicating element.

Preferred embodiments provide an information-broadcast location 142 that is vertically disposable between a scope and the rifle on which that scope is to be mounted. Desirably, the information-broadcast location is vertically disposable between an optical axis of the scope and the rifle bore centerline. It is further preferred for the information-broadcast location to be intersected by a plane passing vertically through the centerline of the rifle bore at a horizontal shooting orientation. For example, bubble 126 is intersected by the recited vertical plane when a rifle carrying a scope on a fixture 100 is disposed at a level shooting condition. Such an arrangement permits the scope and rifle to inherently shield the level-indicating element from undesired contact with foreign objects, and thereby resists loss of level calibration.

Figure 6:
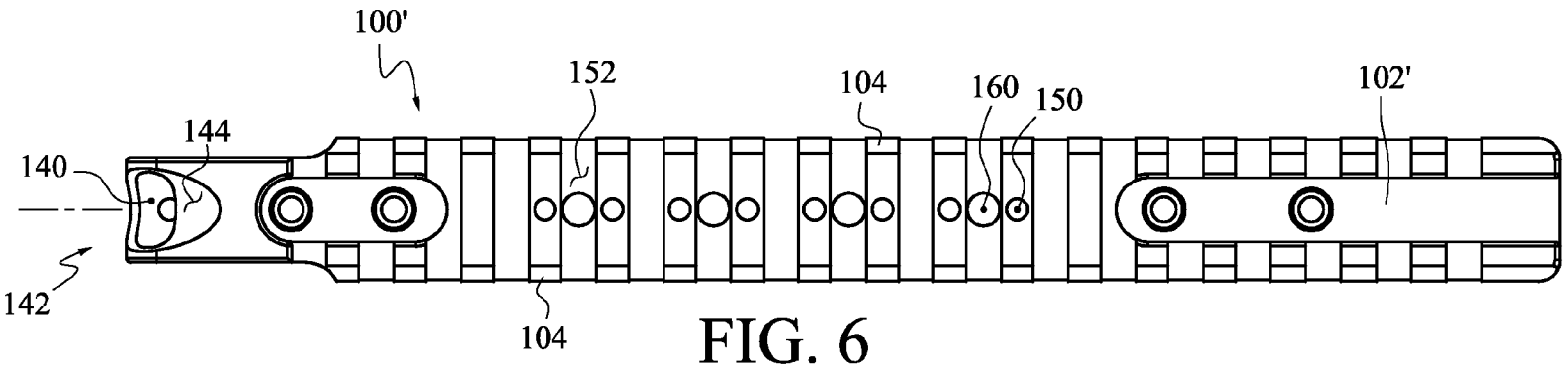
FIG. 6 is a top view of the embodiment in FIG. 4.

It is preferred for opening 140 to be partially bounded by an arcuate surface 144 (see FIG. 6). Advantageously, such surface 144 may be configured to additionally illuminate a level-indicating element (e.g. bubble 126) by reflecting ambient light. A preferred surface 144 may be characterized as a proximally-sloping arcuate surface configured to direct ambient light through a bubble 126 and toward the sighting eye of a shooter. It is within contemplation to further include one or more light-gathering element, such as fiber optic elements, to increase illumination of a level-indicating element 124. Alternative level-indicating elements may also be structured to produce illumination, such as by glowing. Surface 144 desirably is reflective, but it is alternatively within contemplation that surface 144 may be colored, such as with a high-contrast medium, to assist a shooter to better see the bubble.

With reference to FIGS. 5 and 6, body 102' carries a plurality of sockets 150 disposed perpendicular to, and opening to, a top surface 152 of fixture 100'. As illustrated, the length axes of sockets 150 are spaced apart along a length axis of fixture 100' and also disposed transverse to a length axis of an installed level-indicating element 124. Sockets 150 can be used during machining to maintain centerline orientation of the transverse socket 122 with respect to both the length axis of body 102' and rifle-interface surfaces 110 and 110'. Consequently, a machined body may be installed on a designated rifle, and the level-indicating element 124 will inherently be oriented to detect undesired rifle cant. No additional calibration is required, and no other leveling tools are necessary to place a fixture (e.g 100 or 100') in operable association with the designated cooperating rife on which the fixture is mounted.

A rifle and installed fixture, or scope mount, can be held in a horizontal shooting orientation, and a scope may be anchored onto the fixture. A convenient holding mechanism includes a shooting bench equipped with a vice. The level-indicating element of the fixture may be used to ensure there is no cant present in the rifle's held position. A scope can then be quickly and accurately installed by referencing a vertical reticle of the scope with a plumb line, or other known vertical element that is visible through the scope. Alternatively, a horizontal reticle can similarly be aligned with a known horizontal element visible through the installed scope.

In addition to sockets 150, the illustrated embodiment 100' includes a plurality of through-holes 160. Machining operations may be performed on a body 102' by securing a plurality of fasteners in penetration through cooperating through-holes 160 and into engagement with a fixture backing. Pins received in sockets 150 then enforce alignment of the body during certain machining operations. However, many clamping options are available to hold a body while machining, and all of the sockets 150 and through-holes 160 are optional. However, if desired for other reasons, one or more set of such penetrations may be included in a fixture, such as illustrated fixtures 100, 100'. Certain penetrations may be desired to serve as anchor structure to secure an accessory to a rail body 102. Other times, penetrations may be provided to lighten the fixture, itself, or simply to create a distinctive appearance.

Figure 9:
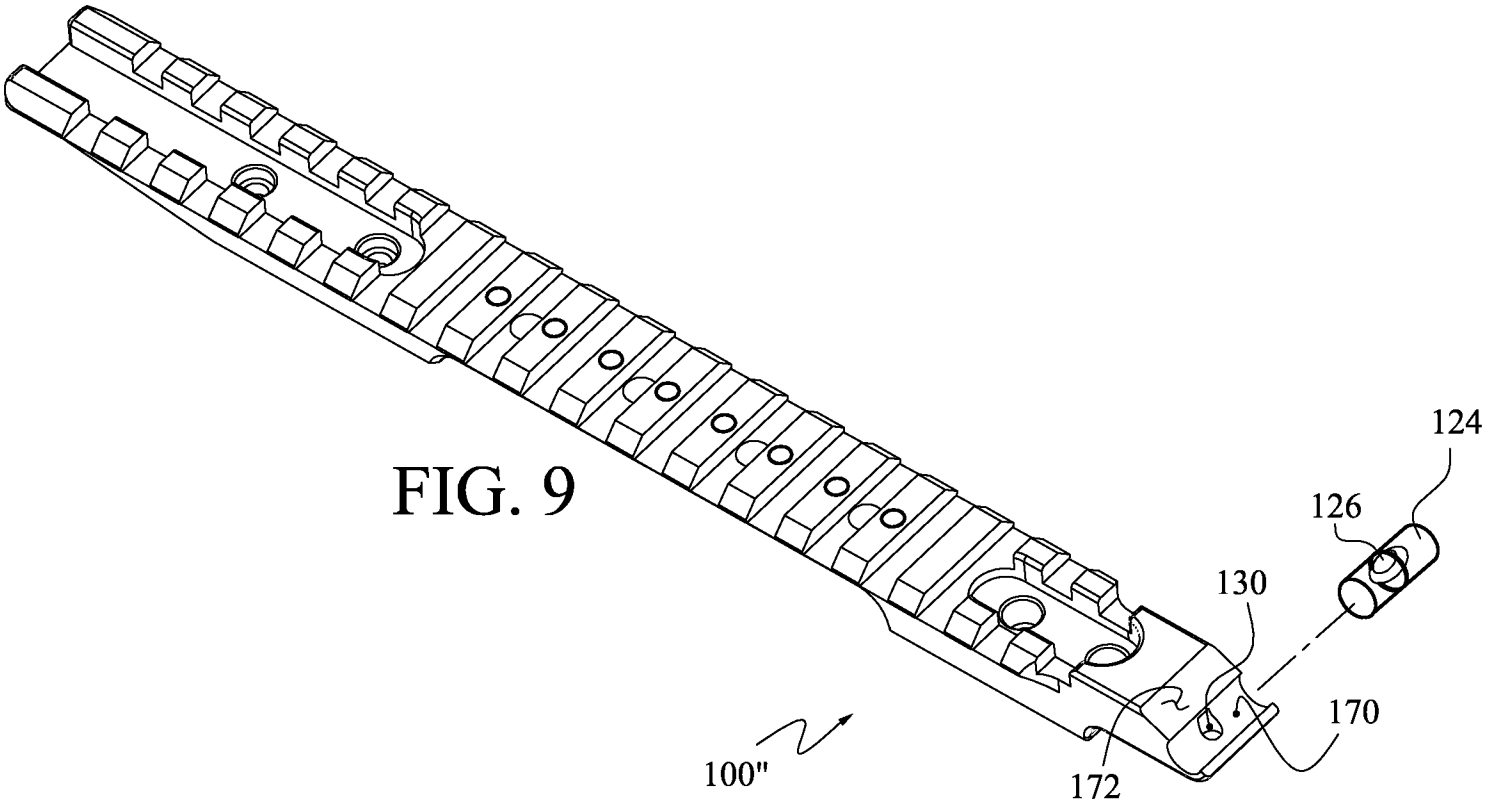
FIG. 9 is a perspective view from above of an alternative embodiment structured according to certain principles of the invention.
Figure 10:
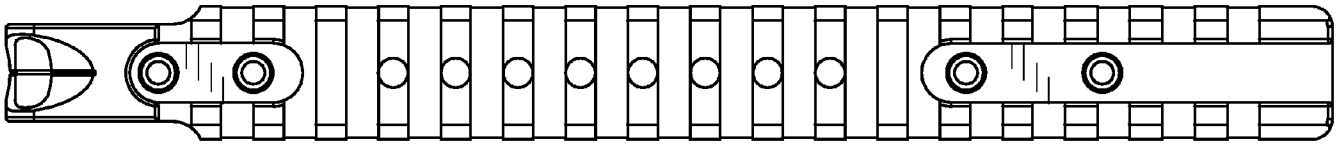
Figure 11:
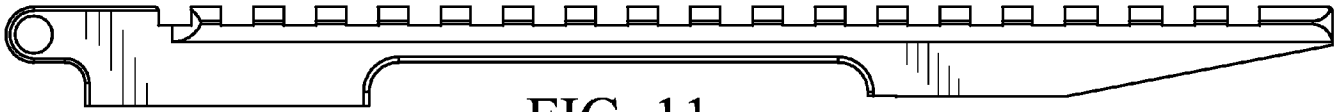
Figure 12:
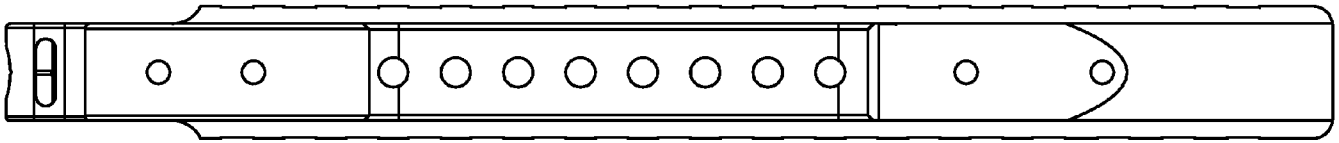
Figure 18:
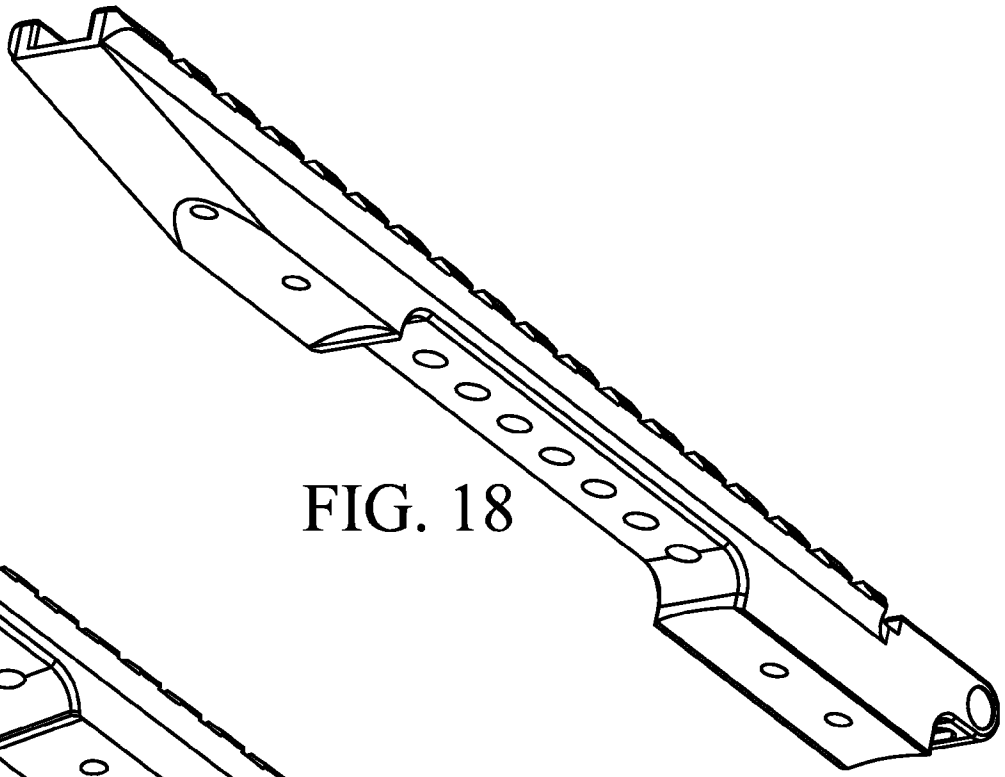
Figure 17:
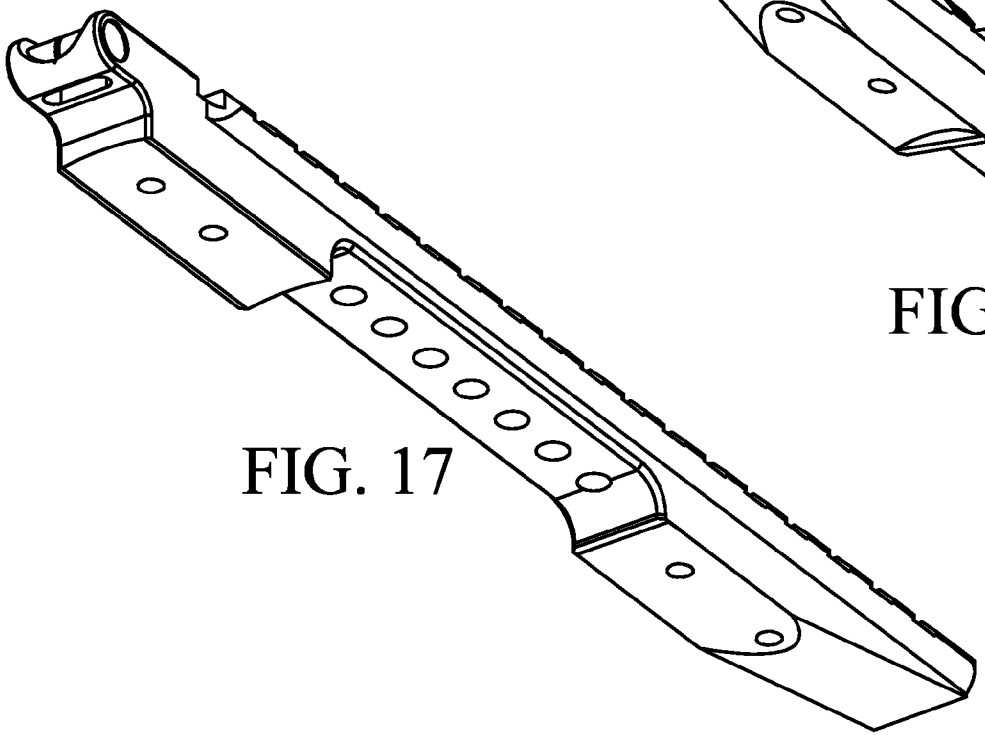
Figure 19:
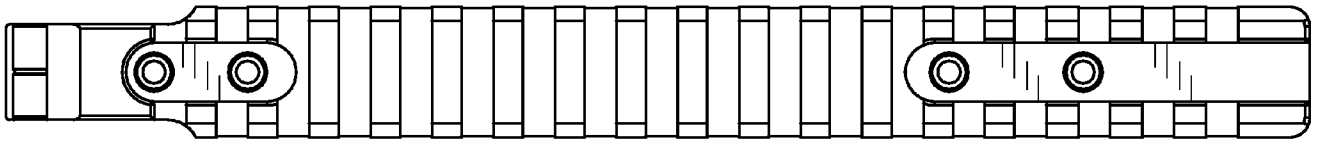
Figure 20:
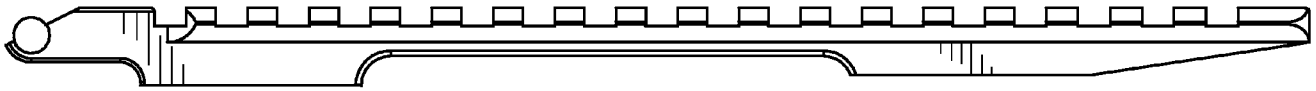
Figure 21:
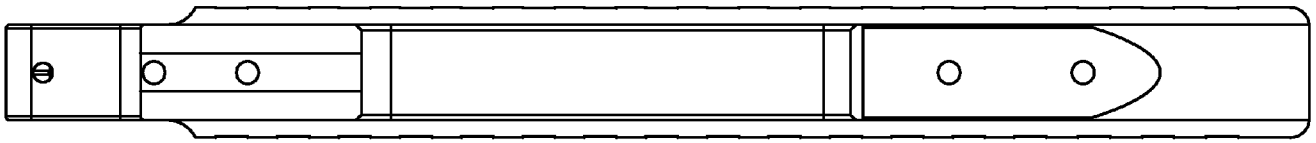
Figure 27:
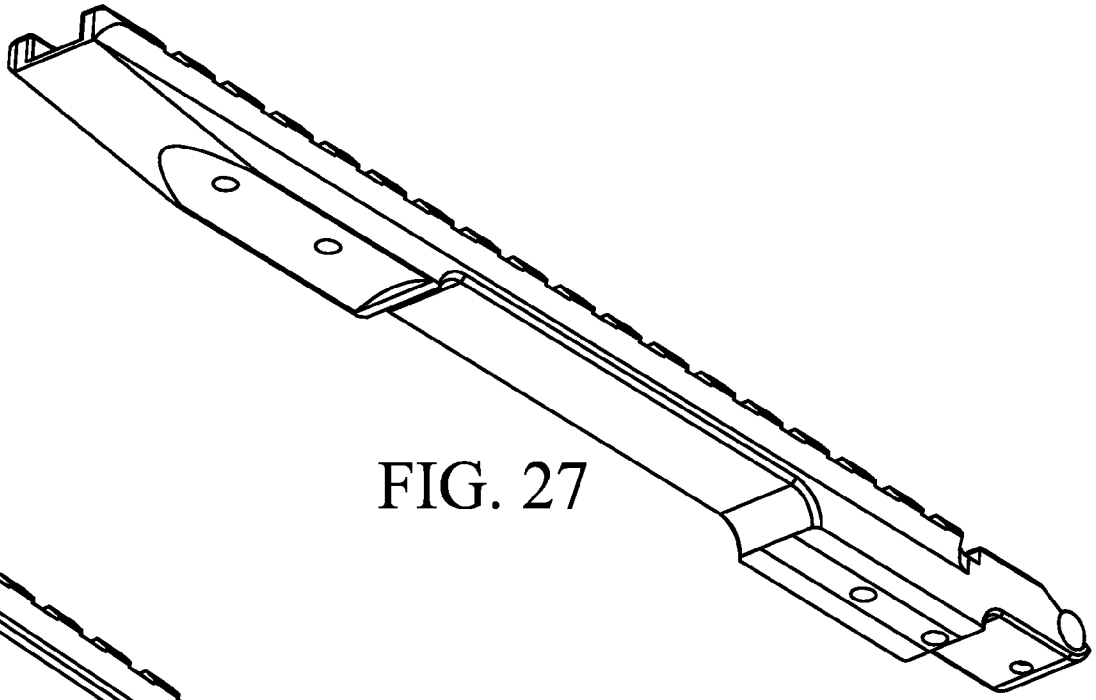
Figure 26:
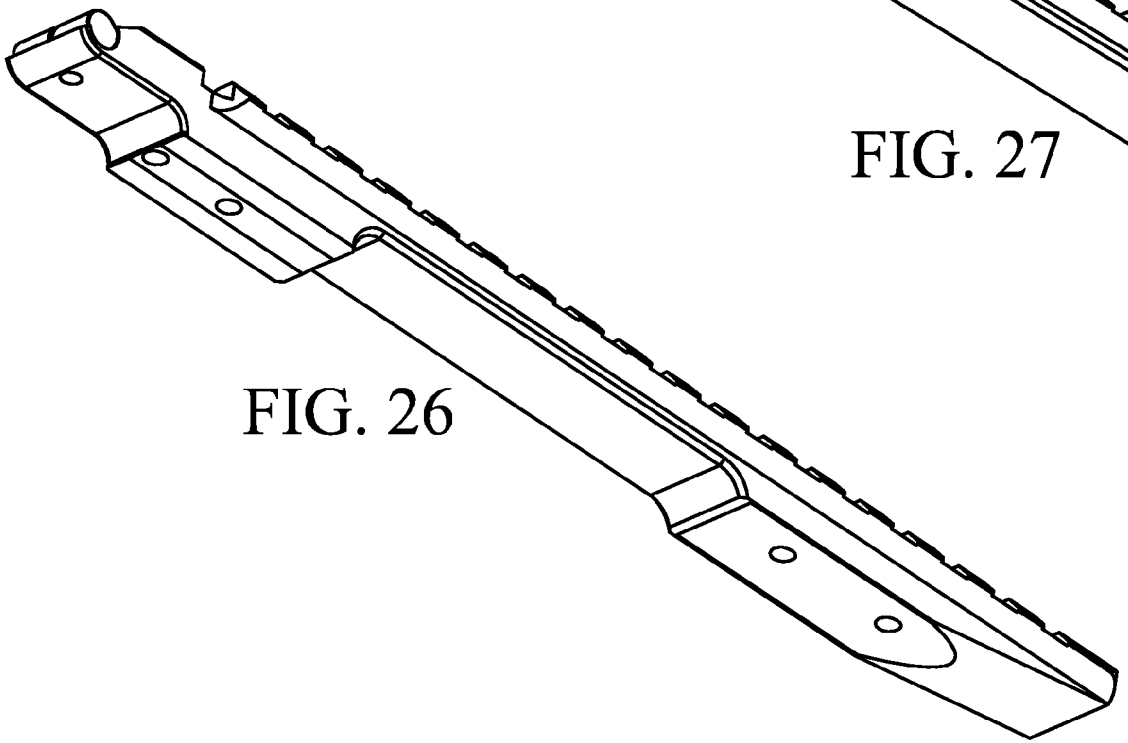

FIG. 9 illustrates an alternative embodiment 100" having an open groove 170 in which to receive a level vial 124. Embodiment 100" offers certain manufacturing advantages. Rather than sliding along an insertion axis, a level-vial can be installed transversely. Through hole 130 provides a passageway through which to apply adhesive to hold a level-vial 124 in installed position. Angled surface 172 is sometimes structured to reflect ambient light toward the level vial. Other times, the surface 172 may be provided with a high-contrast color to increase a shooter's perception of a level bubble 126.

While the invention has been described in particular with reference to certain illustrated embodiments, such is not intended to limit the scope of the invention. The present invention may be embodied in other specific forms without departing from its spirit or essential characteristics. For example, a level-indicating element may be incorporated directly into the action of certain rifles, and disposed at a location that is observable by a shooter substantially in a shooting position. A scope mount base according to certain aspects of the invention can also be formed as an integral portion of a rifle. Therefore, the described embodiments are to be considered as generally illustrative and not restrictive. The scope of the invention is, therefore, indicated by the appended claims rather than by the foregoing description. All changes which come within the meaning and range of equivalency of the claims are to be embraced within their scope.

What is claimed is:

1. In a mounting fixture of the type including an elongate rail with a first side structured for removable attachment to a rifle and a second side providing a male dovetail for joining a scope to the rifle by way of a conventional scope-mounting ring, the improvement comprising:

a level-indicating element incorporated as a non-removable element of said rail; wherein subsequent to attachment of said rail to said rifle, said level-indicating element is disposed at an information-broadcast location at which a shooter of said rifle may visually obtain feedback regarding cant of the rifle on which said fixture is mounted while said shooter remains substantially in a conventional cheek-down horizontal shooting position.

2. The improvement according to claim 1, wherein:

said information-broadcast location is intersected by a vertical plane passing through a bore centerline of a barrel of said rifle when said rifle is disposed in said horizontal shooting orientation.

3. The improvement according to claim 2, wherein:

said information-broadcast location is vertically disposed between said scope and said rifle.

4. The improvement according to claim 2, wherein:

said information-broadcast location is vertically disposable between an optical axis of said scope and said bore centerline.

5. The improvement according to claim 2, wherein:

said information-broadcast location is vertically disposable below an optical axis of said scope.

6. The improvement according to claim 1, wherein:

said level-indicating element is disposed inside a socket formed in said rail.

7. The improvement according to claim 6, wherein:

said socket has a length axis disposed transverse to a length axis of said rail.

8. The improvement according to claim 6, wherein:

a wall portion of said socket comprises a first opening through which an adhesive may be applied to maintain said level-indicating element in installed registration inside said socket.

9. The improvement according to claim 6, wherein:

a wall portion of said socket comprises a first opening through which an element may be inserted to maintain said level-indicating element in installed registration inside said socket.

10. The improvement according to claim 9, wherein:

a wall portion of said socket comprises a second opening through which a shooter may observe a bubble.

11. The improvement according to claim 10, wherein:

a boundary of said second opening comprises a proximally-sloping arcuate surface configured to direct ambient light through said bubble and toward an eye of said shooter.

12. The improvement according to claim 10, wherein:

a boundary of said second opening comprises an arcuate surface configured to additionally illuminate said bubble with ambient light.

13. The improvement according to claim 1, wherein:

said rail comprises a rifle interface structured for bolt-on coupling of said fixture to a rifle effective to position said level-indicating element in operable association with said rifle simply by way of coupling said rail to said rifle.

14. The improvement according to claim 13, wherein:

said rifle interface comprises a plurality of axially spaced-apart contact surface areas, each such contact surface being configured in agreement with a cooperating mounting surface of a rifle.

15. The improvement according to claim 1, wherein:

said rail comprises a scope interface configured to couple with intermediary scope ring structure effective to hold a scope in registered assembly to said rail.

16. The improvement according to claim 1, further comprising:

a plurality of sockets disposed perpendicular to, and opening to, a top surface of said rail, the length axes of said sockets being spaced apart along a length axis of said rail and disposed transverse to a length axis of said level-indicating element.

17. In a picatinny rail structured in substantial accordance with MIL-STD-1913 (AR) 3 Feb., 1995, the improvement comprising:

a level-indicating element incorporated as a non-removable element of said rail, said level-indicating element being disposed at an information-broadcast location at which a shooter of said rifle may visually obtain feedback regarding cant of the rifle on which said rail is mounted while said shooter is substantially in a cheek-down shooting position.

18. The picatinny rail according to claim 17, wherein:

said level-indicating element is disposed in a socket having a length axis transverse to a length axis of said rail, said level-indicating element comprising a bubble intersected by a vertical plane passing through a length axis of said rail when installed on a rifle and disposed in said conventional horizontal shooting orientation, said bubble then being disposed at a position to permit observation by a shooter at an elevation between a scope mounted to said rail and a rifle on which said rail is mounted;

a wall portion of said socket comprising a first opening through which an element may be inserted to maintain said level-indicating element in installed registration inside said socket; and a wall portion of said socket comprising a second opening through which a shooter may observe said bubble.

19. The picatinny rail according to claim 18, further comprising:

a plurality of sockets disposed perpendicular to, and opening to, a top surface of said rail, the length axes of said sockets being spaced apart along a length axis of said rail and disposed transverse to a length axis of said level-indicating element and;

a boundary of said second opening comprises a proximally-sloping arcuate surface configured to direct ambient light through said bubble and toward an eye of said shooter.

20. A scope mount for a rifle, comprising:

an elongate rail structured for removable attachment to a rife, a portion of one side of said rail being structured in agreement with a cooperating mounting surface of said rifle, the opposite side of said rail carrying a male dovetail for attachment of a conventional scope-mounting ring;

a level-vial incorporated as a conventionally non-removable element of said rail, said level-vial being disposed in a vial-socket, said vial-socket being formed in a body of said rail and having a center-axis disposed transverse to a length axis of said body, a portion of said rail being configured to urge ambient light through said level-vial and toward an eye of a shooter, a bubble element of said level-vial being disposable for intersection by a vertical plane passing through said length axis when said scope mount is carried on a rifle that is disposed in a conventional horizontal shooting orientation, said bubble element then being disposed at an elevation between a scope affixed to said rail and a rifle on which said rail is carried to permit cheek-down observation by said shooter;

a wall portion of said vial-socket comprising a first opening through which said shooter may observe said bubble element to visually obtain feedback regarding cant of the rifle; and a plurality of sockets disposed perpendicular to, and opening to, a top surface of said mount, the length axes of said sockets being spaced apart along a length axis of said mount and disposed transverse to a length axis of said level-vial.

* * * * *